US006240606B1

(12) United States Patent
Hiroki

(10) Patent No.: US 6,240,606 B1
(45) Date of Patent: Jun. 5, 2001

(54) FASTENER WITH REMOVABLE HEAD

(75) Inventor: Toyohisa Hiroki, Tokyo (JP)

(73) Assignee: Tosca Co., Ltd., Tokyo (JP)

( * ) Notice: Subject to any disclaimer, the term of this patent is extended or adjusted under 35 U.S.C. 154(b) by 0 days.

(21) Appl. No.: 09/376,322

(22) Filed: Aug. 18, 1999

(30) Foreign Application Priority Data

Aug. 24, 1998 (JP) ..... 10-237598

(51) Int. Cl.[7] ..... A44B 21/00; B65D 63/00

(52) U.S. Cl. ..... 24/704.1; 24/16 PB; 24/30.5 P; 24/3.4

(58) Field of Search ..... 24/16 PB, 30.5 P, 24/17 AP, 3.4, 115 F, 597, 546, 704.1; 119/14.1

(56) References Cited

U.S. PATENT DOCUMENTS 3,686,717 * 8/1972 Merser ..... 24/704.1
4,263,697 * 4/1981 Speedie ..... 24/30.5 P
4,263,730 * 4/1981 Clements ..... 40/20 R
4,347,932 * 9/1982 Furutu ..... 24/704.1
4,501,049 * 2/1985 Adamson ..... 24/30.5 P
5,027,477 * 7/1991 Seron ..... 24/3.4
5,414,903 * 5/1995 Porteous ..... 24/3.4
5,463,799 * 11/1995 Graham ..... 24/704.1

* cited by examiner

*Primary Examiner*—Victor N. Sakran
(74) *Attorney, Agent, or Firm*—Arent Fox Kintner Plotkin & Kahn

(57) ABSTRACT

A bar 3 is provided on one extremity of an elongated filament part 2, a head 4 is provide on the other extremity of the filament part 2 and, at the same time, a removing portion 6 is provided between this head 4 and the filament part 2, and it is so composed that the head 4 and the filament part 2 can be separated easily, and a fastener affixed to the product S can be removed by manual operation.

15 Claims, 5 Drawing Sheets

FASTENER WITH REMOVABLE HEAD

BACKGROUND OF THE INVENTION

The present invention relates to a fastener integrally made of synthetic resin such as nylon or propylene, for binding a plurality of or a plurality of pairs of products including particularly towels or socks, permitting to remove itself from the product, when releasing this binding, or by simply cutting its head by hand.

For example, fasteners made of synthetic resin is normally used to attach a price tag or a label to the product, or to bind a plurality of or a plurality of pairs of towels or socks.

And, as for a fastener used mainly for attaching a price tag, called "tag pin", an assembly of fasteners are molded integrally with molecular oriented thermoplastic synthetic resin such as nylon, by forming a bar in T at one extremity of an elongated filament part, by forming the whole in H by providing a flat head at the other extremity, and in a state where 50 to 150 fasteners are planted on a linkage rod (member corresponding to a backbone) by intermediate of a linkage portion disposed at the center of the bar, and moreover, the filament part is made thinner and more tough by extending by a predetermined factor.

Recently, a plurality of towels, socks or other textile products are sold lumped together and, for this effect, a method has became adopted for binding a plurality of or a plurality of pairs of towels or other textile products, by shortening the filament part of fastener for attaching the price tag than the one for attaching the price tag.

For attaching such fastener to a textile product or the like, an assembly of fastener is charged in a pistol type applicator device, a hollow needle fitted to the tip of this applicator device is penetrated into a plurality of or a plurality of pairs of piled up towels, socks or other textile products and, then, the bar of a single fastener is fixed at the back of the textile product by pushing it out of the hollow needle tip by gripping a lever protruding in front of a grip portion, and the bar pushed out from the hollow needle restores its original form by the spring stress of a junction portion with the filament part, namely, so that the bar will be directed forming a T-form in respect of the filament part and fixed to the back side of stocks or towels.

As described above, when textile products are bundled, as the fastener penetrates into compressed textile products, its head and bar will be fixed eating into both faces of such textile products.

The fastener used for attaching the price tag has a relatively long filament part between the product and its head, and the price tag is supported loosely in respect of the filament part, so it is necessary to cut the filament part with scissors or a knife to cut off the price tag from the product for removing the fastener.

On the other hand, as mentioned above, if a plurality of towels or other compressible textile products are bundled in a condition tighten by driving a fastener into them, its head and bar bite into both faces of the textile products leaving no room for operating scissors or a knife if one wants to cut the fastener.

Also, it is difficult to tear off the head by stress, because it leaves little portion to grasp by hand. In other words, as the filament part is made as strong as a silken gut by extension, it can only be broken by a tensile strength of equal or superior to 10 kg, giving damages to the textile product.

Thus, if soft towels, socks or other textile products are bundled using a fastener with a short filament part, its head and bar positioned on the face and back of such bundle will bite into the towel surface and be buried therein. This small bar (0.8 mm in diameter, 9 mm in length) can not possibly be held by finger tips and, moreover, even its head having an area relatively larger than said bar can hardly be pinched with finger tips and, it can not be torn off by hands.

Therefore, the tip of scissors or a knife can not reach at the filament part of a fastener buried in the textile product and, if one try to cut by stress the filament part with scissors penetrated into the textile product, fibers of towels or other the textile products may be cut out.

On the other hand, conventionally, an idea of fastener of attaching the price tag has been proposed to leave a non extended portion on a portion of the head side of the filament part and to dispose a small diameter cutting portion on this non extended portion; however, the non extended portion presents a far less strength in comparison with the filament part made thinner and stronger by the extension, bends easily deteriorating the physical aspect, so it can not really be applied to the price tag attachment.

SUMMARY OF THE INVENTION

The present invention is devised in consideration of shortcomings of said conventional fastener and has an object to provide a fastener presenting a necessary strength for fixing the product so that the filament part will not break even when a tensile stress is applied to this filament part, wherein the junction portion between the head and the filament part or its proximity by twisting or pulling off the head and such broken portion can be pulled off from the product to separate simply this product.

The fastener according to the present invention is composed as follows:

1) The fastener is provided with a bar on one extremity of an elongated filament part and with a head on the other extremity respectively and, at the same time, a "removing portion" is provided at a junction portion between this head and the filament part or in the vicinity thereof, and a "breaking portion" is disposed in this removing portion to form a locally weak portion.

This removing portion means that the junction portion between the head and the filament part can be separated easily and, the head and the filament part can be separated by intermediate of the breaking portion forming this removing portion by pinching the head with finger tips to twist of bend the same.

As this breaking portion, usually the one formed by a thin portion between the filament part and the head portion is adopted, but the one wherein the thin portion if shorten in conformity with this is to be adopted. Besides, the breaking portion can be provided directly in the vicinity of the junction portion between the head and the filament part.

According to the present invention, as the breaking portion is not disposed directly on the filament part, this filament part will not break nor extend, even when a tensile stress within the predetermined range is applied during the elongation of this filament part or the product handling.

However, the head portion and the filament part can easily be separated to remove the fixing piece from the textile product, by folding or twisting the breaking portion disposed at the head, in order to remove the fastener from towels, socks or other the textile products.

2) In the fastener according to the present invention, a removing portion is disposed at the junction portion between the head and the filament part and, a breaking portion is provided on this removing portion.

In the fastener according to the present invention, a removing portion is disposed at the edge portion of the head facing the bar and, a small bar form or a film form piece facing with the edge of the head is to be separated by breaking the head at the removing portion.

This small bar form or a film form piece separated from the edge of the head is narrow (thin) and weak in the limit of not to damage the product, and it deforms into V or Y-form by the resistance of the product when the filament part is pulled out allowing to pull out easily.

3) The fastener according to the present invention is characterized by that the breaking portion formed at the removing portion is made thinner by forming a groove in the transversal direction to the head.

In the fastener according to the present invention, as the breaking portion is formed as a transversal groove, the head can be separated easily from the head by intermediate of this braking portion and pulled out from the filament, by bending or twisting the head.

4) The fastener according to claim 4 of the present invention, is characterized by that the breaking portion formed at said removing portion presents a strength that can resist the product binding but that can be broken by manual operation.

According to the present invention, the head can be separated from the fastener and the fastener can easily be removed from the product by affording to the head a stress different from the binding stress, or a stress stronger than this binding stress or a stress that would detach the head from the product.

5) In the fastener according to the present invention, a breaking portion is formed on the head itself joined to the filament part, with such strength that will break when a tensile stress equal or superior to a predetermined stress is applied to the filament part.

According to the present invention, basically, a removing portion lies at the junction portion between the head and the filament part; however, if this removing portion is not provided, a breaking portion can be formed at the head itself.

This breaking portion can be formed by perforating a hole at the head side of the junction portion between the filament part and the head so that the breaking starts from this hole portion.

However, in the fastener of this structure, supposing that it is necessary to improve the strength by elongating the filament part, it is required to adopt such a structure that can bear the stress to elongate this filament part at the head side.

DESCRIPTION OF THE PREFERRED EMBODIMENT

Figure 1:
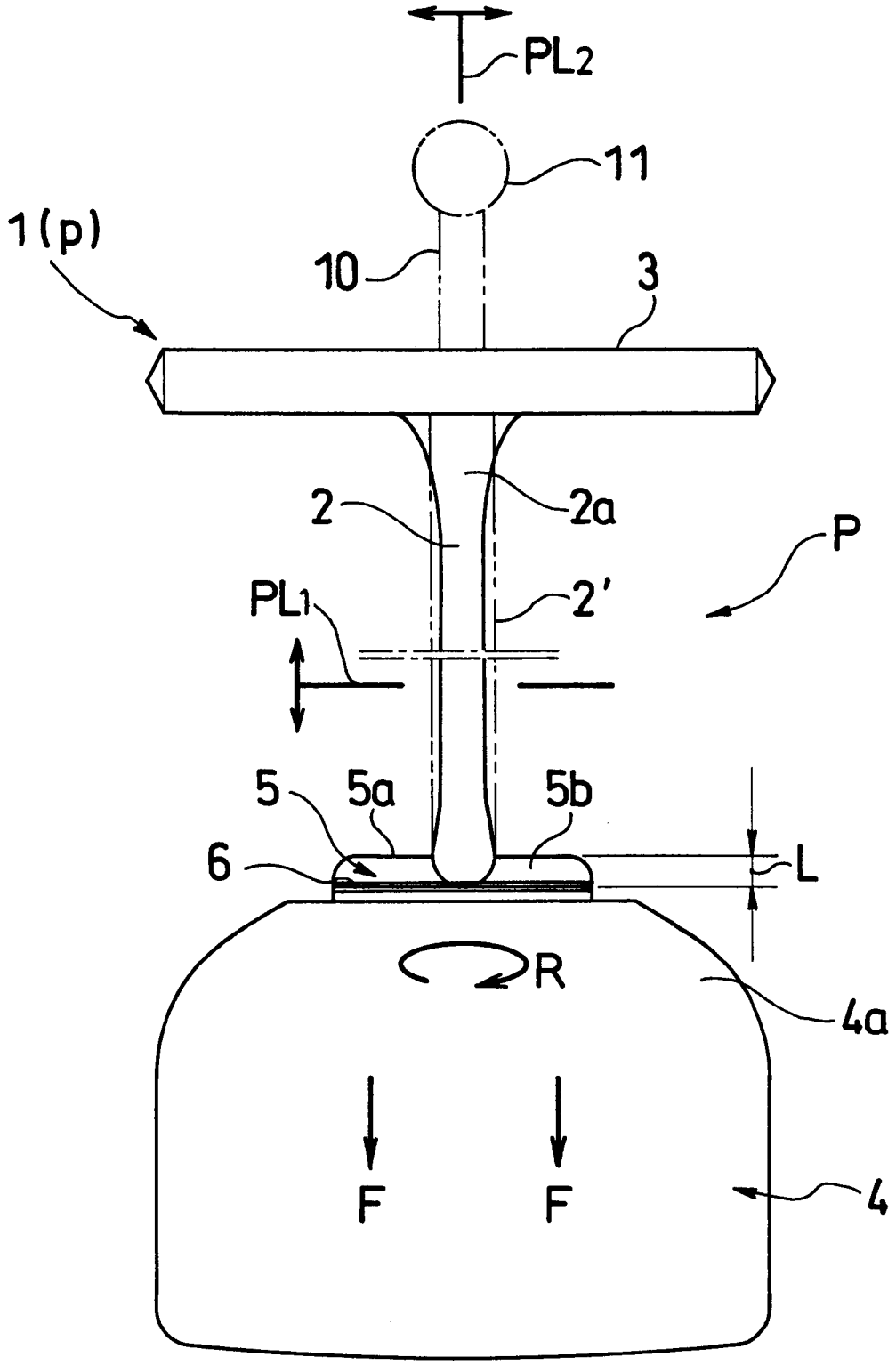
FIG. 1 is a front view showing an example of the fastener according to the present invention.

Now the embodiment of the present invention will be described referring to the drawings.

As shown in FIG. 1, a fastener is molded with synthetic resin integrally as an assembly of fasteners including the portion indicated by two-dot long and two short dashes lines and, this fastener 1 is composed of a filament part 2, a bar 3 provided at one extremity of the fi lament part 2 and a flat head 4 disposed at the other extremity of the filament part.

For example, 50 to 150 or more fasteners 1 are formed implanted as a comb on a link rod 11 by intermediate of a linkage portion 10 indicated by two-dot long and two short dashes lines to said bar 3.

Synthetic resins to be used include polypropylene, nylon or other molecular oriented thermoplastic resins and, they can be colored with a desired color by blending the synthetic resin with pigments before molding, according to the application of this fastener 1.

This fastener 1 is manufactured by "intra-dice elongation method" and, after the integral molding as an assembly as shown in FIG. 1 in dice, the filament part 2 is elongated by about 3 to 4 times evenly and substantially over the total length by displacing one die in respect of the other from a parting face PL1 orthogonal to the fi lament part. Then, a parting face PL2 joining face of the upper and the lower dice) orthogonal to said parting face PL1 is opened to take out the assembly of fasteners 1 from the dice.

After such elongation, the filament part 2 is smaller in diameter and stronger the non-elongated filament part 2' indicated by two-dot long and two short dashes lines as silken gut and presents such a strength that it can no more be torn off easily by hands.

During the elongation operation of this filament part 2, a stress is to be applied to a removing portion 5 formed at the edge of the bar 3 and the head 4. Moreover, as for this filament part 2, the strength of a root portion 2*a* with the bar 3 and the filament part 2 is improved by said elongation operation and, the bar 3 pushed out from the hollow needle at the tip of a not shown applicator restores the original configuration by the spring stress of the filament part, namely, so that it will be directed orthogonal in T to the filament part 2. Note that the bar 3 is formed to present a diameter substantially equivalent to the diameter of the nonelongated filament part 2'.

On the other hand, the head 4 is formed in flat plate form it self, with edge portions 4*a* of the filament part 2 side reduced to an arc form. And, between these two edge portions 4*a,* a removing portion 5 narrower that the width of the head 4 is formed and, additionally, a breaking portion 6 applied in the present invention is provided in the direction transversal to this removing portion 5.

(Breaking portion)

Figure 2:
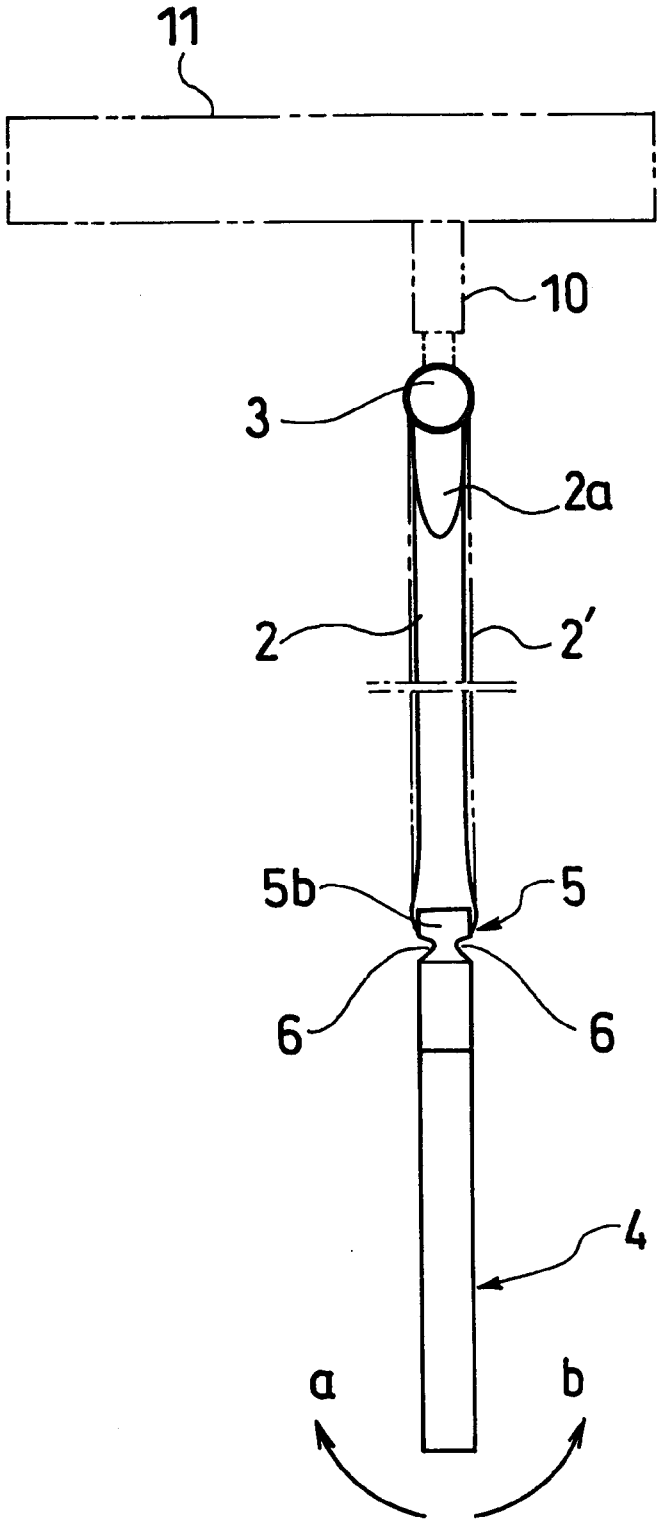
FIG. 2 is a side view of the fastener of FIG. 1.

As shown in FIG. 2, this breaking portion 6 is formed by a pair of surface and back transversal grooves in V or in neck-form disposed in opposition the one the other on the both surface and back face of the removing portion 5.

Figure 3:
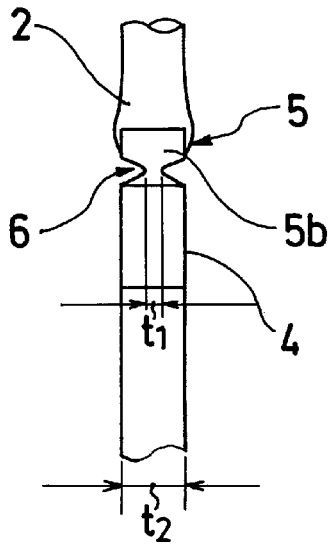
FIG. 3 is an enlarged side view of the essential parts of the fastener of FIG. 1.

Its thickness, namely the distance t1 between the bottom of a pair of opposed breaking portions 6, 6 is formed thin of about ⅓ the plate thickness t2 of the head 4 as shown in FIG. 3. Therefore, this removing portion 5 can be separated easily from the head 4 by folding or twisting by intermediate of the breaking portion 6.

Said breaking portion 6 forms a part of the head 4 and, as shown in FIG. 1, even if a stress F (tensile stress) to elongate the filament part 2 is applied to this head 4, it will not break because this breaking portion is engaged with and supported by the die.

However, as shown in FIG. 2, this braking portion 6 can easily be torn off, for example, by blocking with the tip of one hand (left hand for instance) the vicinity of the reduced removing portion 5*b* which is a part of the removing portion 5 and folding the head 4 at the thin portion of the breaking portion 6 alternatively in the directions of the arrow a or b with the tip of the other hand (right hand for instance).

As another breaking method, the entire breaking portion 6 can be broken and removed by pinching the reduced removing portion 5*b* of the removing portion 5 with one finger tips and twisting the head 4 in the crossing direction in respect of this removing portion 5*b,* namely, as shown by the arrow R in FIG. 1.

Said breaking portion 6 of transversal groove presenting a V-form cross-portion is spaced by a predetermined distance L (even if it is a slight distance) from a front end face 5*a* of the removing portion 5 as shown in FIG. 1, and when this breaking portion 6 is broken and the head 4 is separated from the filament part 2 side, this removing portion 5 will constitutes a piece or thick film form reduced removing portion 5*b* which is smaller by the width of said distance L and remains in T at the extremity of the filament part 2 in parallel to the bar 3.

Figure 4:
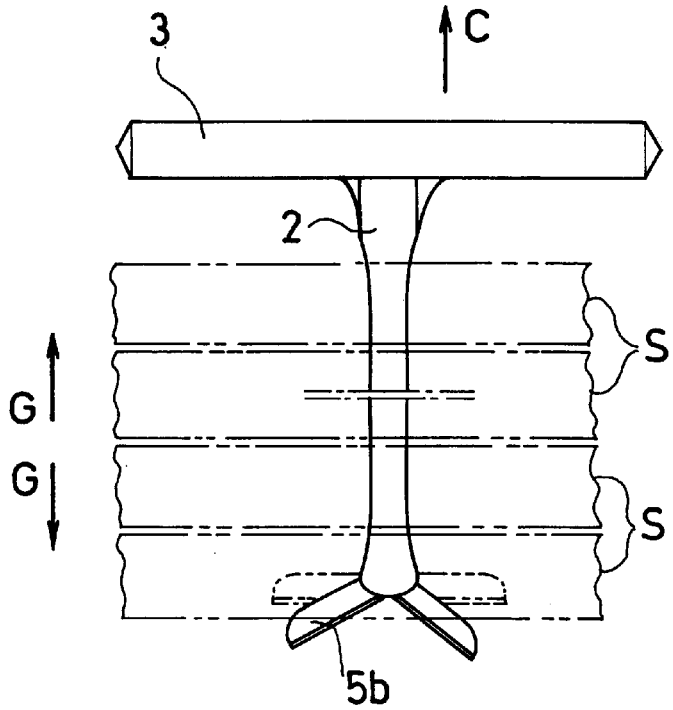
FIG. 4 illustrates the function of the fastener of FIG. 1.

As the consequence, this thin and reduced removing portion 5*b* presents such a strength that allows to bend easily into V- or U-form the narrow removing portion 5*b* remaining on the filament part 2 side as shown in FIG. 4, by applying a stress (preferable equal or superior to the product binding stress) to the same 5*b*.

Moreover, as mentioned above, the filament part 2 is connected to the head by intermediate of the removing portion 5; however, as the extremity of this filament part 2 is not elongated, as shown in FIG. 1, apparently, the removing portion 5 seems to eat into the extremity 2*a* of this filament part 2.

Consequently, in a state where the head 4 is removed from the removing portion 5, a stress G, G diving into to is applied to the towels, socks or other products S pinched between this head 4 and the bar 3, the removing portion 5*b* reduced into a thin rod or film can be folded into V- or U-form and pulled off from a part of the products S and, further, by pulling off thus deformed removing portion 5*b* from these products S, the fastener can be extracted.

For instance, if a bundle of bought socks is to be unbundled to wear them on, this braking portion 6 can easily be torn off to remove the head 4, by pinching with the tip of one hand the filament part 2 and the removing portion 5, folding the breaking portion 6 by pinching and moving the head 4 alternatively in the directions of the arrow a and b with the tip of the other hand as shown in FIG. 2.

Then, as shown in FIG. 4, if a plurality of socks S are divided by applying a stress as indicated by arrows G, G, this stress G will be applied to the reduced removing portion 5*b* through the bar 2 and the filament part 2 in contact with the one sock S side and folded the removing portion 5*b* into V, allowing to separate the bundle of socks S from the center.

Next, the reduced removing portion 5*b* can easily be removed by pinching the bar 2 remaining on the one bundle of socks S and pulling it off with the filament part 2 as indicated by the arrows C, allowing to separate the socks individually.

Here, the thin and reduced removing portion 5*b* which is a part of the removing portion 5, remaining on the filament part 2 side after the head 4 removal may be folded more easily by making thinner the center of the removing portion 5 to which the filament part 2 is connected, assuring a more effective break.

Figure 5:
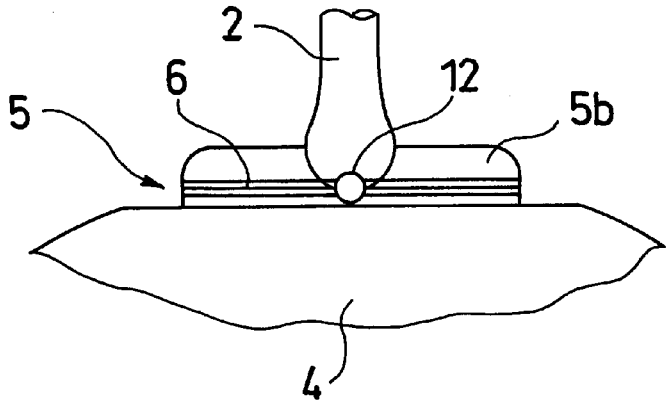
FIG. 5 is an enlarged front view of the essential parts of a variation of the breaking portion.

To be more specific, for example, a through hole 12 (round hole, oval hole) may be disposed at the center of the groove form breaking portion 6, namely, at the root of the filament part 2 as shown in FIG. 5, and the break may start easily form this removing portion by generating a local strain at this breaking portion 6 through this through hole 12 when a tensile stress is applied to the filament part 2.

Figure 6:
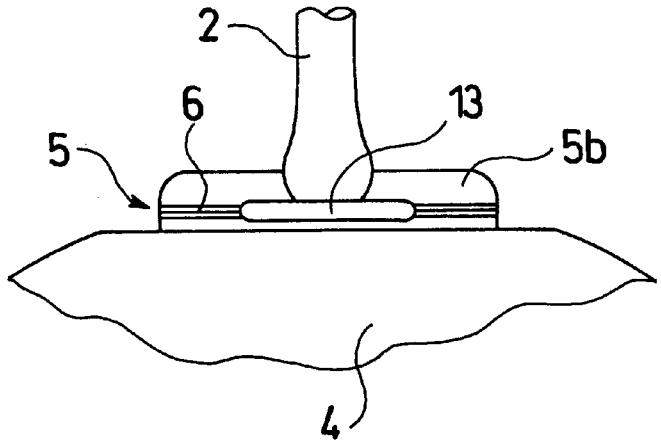
FIG. 6 is an enlarged front view of the essential parts of a variation of the breaking portion.
Figure 7:
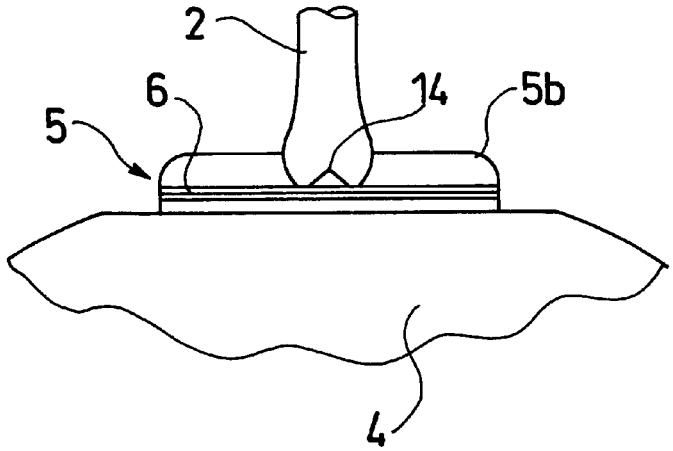
FIG. 7 is an enlarged front view of the essential parts of a variation of the breaking portion.

It will break still more easily by providing a slit 13 at the center of the elongated groove form breaking portion 6 as shown in FIG. 6.

Moreover, it will break more easily than the case shown in FIG. 5, by providing a V-form groove 14 (notch) ath the center of the transversal groove of the breaking portion 6.

The cross-portion of the breaking portion 6 is not limited to the V-form transversal groove, but also, for example, U- or ⊃-form grooves may also be used.

In short, the portion between the filament part 2 and the head 4 may be designed to deploy a sufficient resistance to bundle products S between the filament part 2 and the head 4, but enough weak to remove the head 4 easily when a stress superior to the resistance is applied to the head 4, or a stress bending the head 4 laterally, a stress twisting the head orthogonal to the filament part 2 or to a still larger angle, or a stress dividing the head 4 is applied so that the head 4 can be removed easily by holding this head 4 and applying the stress, and moreover, a part of the removing portion 5 remaining on the filament part 2 side can be folded easily and extracted from the products without damaging the products S.

Said breaking portion 6 of transversal groove shape is preferably formed on both side of the removing portion 5, but it can be provided only on one face, provided that it satisfies the aforementioned conditions.

When the fastener piece is used ordinary, said removing portion does not break and can keep the state as formed in the elongation step of the filament part 2, but it presents a function to separate by intermediate of the breaking portion 6 when a stress folding or twisting the head 4 is applied to the filament 4; therefore, providing a removing portion 5 on the fastener piece is not different from the conventional fastener piece in no way from the functional point of view.

Figure 8:
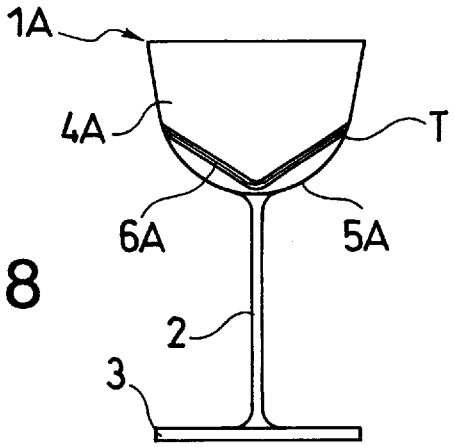
FIG. 8 is a front view of the fastener of another configuration.

FIG. 8 shows a fastener 1A according to another embodiment; in this example, a head 4A is formed in fan shape, and a removing portion 5A having a breaking portion 6A in V at the arc portion to which the filament part 2 is jointed.

The fastener 1A of this type allows to form a long breaking portion 6A and to make the width of the removing portion 5A a narrow V form, and moreover, the elongation step can be facilitated because the stress during the filament part 2 elongation can be burdened sufficiently. On the other hand, this removing portion 5A can be separated easily from the head 1A by hooking a nail to the end portion T of the removing portion 5A by facilitating its break by means of a notch provided at this end portion, or by other means.

Figure 9:
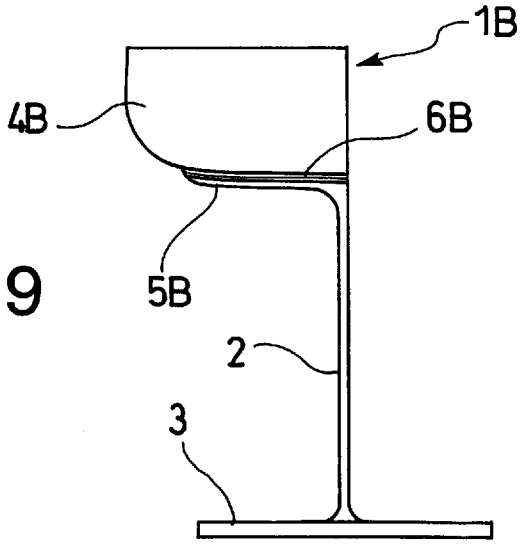
FIG. 9 is a front view of the fastener of another configuration.

FIG. 9 shows a fastener 1B according to still another embodiment, wherein a half head 4B is formed, and a removing portion 5B and a breaking portion 6B are formed at the edge of this head 4B.

As some of this shape may presents unstable parts in the head 4B, it may also be formed by extending a part or whole of the half head 4B into the portion omitted as necessary. In this case, the length of the removing portion 5B may be conveniently formed according to the length of the head 4B.

Figure 10:
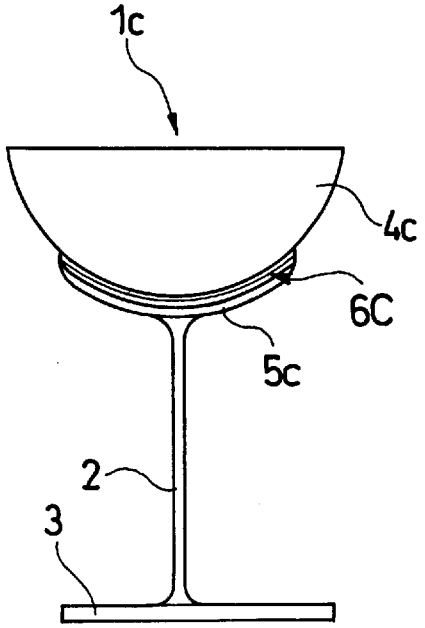
FIG. 10 is a front view of the fastener of another configuration.

In FIG. 10, a fastener 1C is composed to have a semicircular head 4C, and in this fastener 1C, an arc form removing portion 5C and an arc form braking portion 6C are formed.

Various designs are used for the head shape of the fastener according to the present invention for, otherwise, indicating the manufacturing maker, and a head among said various embodiments, or one that is deformed farther based on them may be used, and the removing portion and the breaking portion may appropriately be selected in conformity with this and applied.

The fastener according to the present invention can provide the following effects:

1) As the filament part is deprived of a removing portion, the filament part would not break even if a predetermined tensile stress is applied to this filament parts and, therefore, the filament elongation process can be performed as conventionally, and the fastener can be used following the conventional method.

The head can be broken easily by folding, twisting or tearing by hand the breaking portion disposed on the head to remove the fastener from the product and, the head can be removed easily from the portion of the head connected to the filament part.

2) A removing portion is disposed at the edge of the head facing the bar, and a small bar like one is formed facing the bar by breaking the head from this removing portion.

This bar like one is weak enough not to damage the product, and it can be deformed easily when the breaking portion is cut off from the head by hand, and the filament part is pulled off with the bar, allowing to extract easily without damaging the product.

3) Moreover, in the fastener according to the present invention, as the breaking portion is formed in a transversal groove, the head can be separated easily to remove from the filament part through this breaking portion by folding or twisting the head, allowing to detach easily the fastener from the product by manual operation.

4) The head can be separated from the fastener and the fastener can easily be removed from the product by affording to the head a stress different from the binding stress, or a stress stronger than this binding stress or a stress that would detach the head from the product.

5) As the breaking portion is not interposed between the filament part and the head, but can be formed on the head, at the edge opposed to the bar portion, the breaking portion can be formed with various configurations, structures with various strength, which is also advantageous from the point of view of designing to indicate the source of the fastener.

What is claimed is:

1. A fastener with a removable head provided with a bar on one extremity of an elongated filament extending along a longitudinal axis and with a head on the other extremity respectively, wherein a removing portion is provided at an edge portion of the head facing the bar and the removing portion extends transversely relative to the filament.

2. The fastener with a removable head of claim 1, wherein a breaking portion is provided on the removing portion.

3. The fastener with a removable head of claim 2, wherein the breaking portion formed at the removing portion is made thinner by forming a groove in the transverse direction relative to the longitudinal axis.

4. The fastener with a removable head of claim 2 or 3, wherein the breaking portion formed at the removing portion presents a strength that can resist the product binding but that can be broken by a stress stronger than the binding or twisting of the head.

5. The fastener with a removable head of claim 2 or 3, wherein the breaking portion is formed with a strength that will be broken with a tensile stress equal or greater than a predetermined stress applied to the filament part.

6. A fastener, comprising:

a body member fabricated as a unitary construction from a moldable, pliable material, the body member including an elongated filament part, a bar element, a head, a removing portion and a breaking portion, the filament part extending along a longitudinal axis with the bar element connected to one end of the filament part and extending transversely relative to the longitudinal axis, the head extending longitudinally and transversely from an opposite end of the filament part and away from the filament part, and the removing portion disposed at an edge portion of the head facing the bar element and extending transversely relative to the longitudinal axis, the breaking portion disposed at the removing portion and extending transversely relative to the longitudinal axis.

7. A fastener according to claim 6, wherein the head is detachable from the body member along the breaking portion.

8. A fastener according to claim 7, wherein the head has a head thickness and the breaking portion has a breaking portion thickness less than the head thickness.

9. A fastener according to claim 8, wherein the breaking portion thickness is approximately one-third of the head thickness.

10. A fastener according to claim 7, wherein the bar element forms a T-shaped configuration with the filament element.

11. A fastener according to claim 10, wherein the removing portion and the bar element form an I-beam configuration with the filament element.

12. A fastener according to claim 7, wherein the breaking portion defines a pair of oppositely disposed grooves formed at an edge portion of the head.

13. A fastener according to claim 12, wherein the breaking portion is one of straight, arcuate, and V-shaped.

14. A fastener according to claim 12, wherein a through hole extends through the breaking portion to divide the breaking portion into opposing first and second breaking portion segments disposed on opposing sides of the longitudinal axis.

15. A fastener according to claim 14, wherein the through hole is one of a circular hole, an elongated slit, and a V-shaped opening.

* * * * *

UNITED STATES PATENT AND TRADEMARK OFFICE

CERTIFICATE OF CORRECTION

PATENT NO. : 6,240,606 B1
DATED : June 5, 2001
INVENTOR(S) : Toyohisa Hiroki

It is certified that error appears in the above-identified patent and that said Letters Patent is hereby corrected as shown below:

Item [73], Change "Tosca" to -- Toska --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*